US008095281B2

(12) United States Patent
Peterson et al.

(10) Patent No.: US 8,095,281 B2
(45) Date of Patent: Jan. 10, 2012

(54) SYSTEM FOR CONTROLLING A HYDRAULIC SYSTEM

(75) Inventors: Randal Neil Peterson, Peoria, IL (US); Mike T. Verkuilen, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 604 days.

(21) Appl. No.: 12/333,099

(22) Filed: Dec. 11, 2008

(65) Prior Publication Data

US 2010/0146958 A1 Jun. 17, 2010

(51) Int. Cl.
*G06G 7/00* (2006.01)

(52) U.S. Cl. ..... 701/50; 37/414

(58) Field of Classification Search ..... 701/50; 60/422

See application file for complete search history.

(56) References Cited

U.S. PATENT DOCUMENTS

| | | | | |
|---|---|---|---|---|
| 5,692,376 | A | 12/1997 | Miki et al. | |
| 5,784,945 | A | 7/1998 | Krone et al. | |
| 6,061,617 | A * | 5/2000 | Berger et al. | 701/50 |
| 6,140,787 | A * | 10/2000 | Lokhorst et al. | 318/568.18 |
| 6,518,519 | B1 * | 2/2003 | Crane et al. | 177/136 |
| 6,542,789 | B2 | 4/2003 | Ufheil | |
| 6,732,512 | B2 | 5/2004 | Pfaff et al. | |
| 6,928,353 | B2 | 8/2005 | Finley et al. | |
| 7,099,722 | B2 | 8/2006 | Casey | |
| 7,210,292 | B2 | 5/2007 | Price et al. | |
| 7,431,101 | B2 * | 10/2008 | Hacker | 172/2 |
| 2005/0199120 | A1 | 9/2005 | Bitter | |
| 2005/0283295 | A1 * | 12/2005 | Normann | 701/50 |
| 2006/0112685 | A1 | 6/2006 | Devier et al. | |
| 2006/0156713 | A1 | 7/2006 | Kadlicko | |
| 2006/0218912 | A1 | 10/2006 | Price et al. | |
| 2006/0266027 | A1 | 11/2006 | Ma et al. | |
| 2006/0266210 | A1 | 11/2006 | Zhang et al. | |
| 2007/0044465 | A1 | 3/2007 | Zhang et al. | |
| 2007/0239312 | A1 * | 10/2007 | Andersen et al. | 700/213 |
| 2009/0037072 | A1 * | 2/2009 | Lin et al. | 701/99 |
| 2009/0319133 | A1 * | 12/2009 | Ekvall et al. | 701/50 |

FOREIGN PATENT DOCUMENTS

| | | |
|---|---|---|
| EP | 1403438 | 3/2004 |

* cited by examiner

*Primary Examiner* — James Trammell
*Assistant Examiner* — Michael D Lang
(74) *Attorney, Agent, or Firm* — Finnegan, Henderson, Farabow, Garrett & Dunner LLP

(57) ABSTRACT

A method of operating a hydraulic system is disclosed. The method includes holding an implement configuration in an orientation. The method also includes sensing a pressure within a chamber of a hydraulic actuator associated with the implement configuration when the implement configuration is in the orientation and comparing a first signal indicative of the first sensed pressure with a first pressure value. The method further includes selecting a first functional relationship from among a plurality of stored functional relationships if the first signal is greater than the first pressure value and selecting a second functional relationship from among the plurality of stored functional relationships if the first signal is less than the first pressure value. The method includes controlling the hydraulic actuator based on the selected functional relationship.

20 Claims, 3 Drawing Sheets

SYSTEM FOR CONTROLLING A HYDRAULIC SYSTEM

TECHNICAL FIELD

The present disclosure relates generally to a system for controlling a hydraulic system, and more particularly, to a method and apparatus for controlling a hydraulic system.

BACKGROUND

Machines such as, for example, excavators, loaders, dozers, and other types of heavy machinery typically have a large number of hydraulically controlled implements (such as, for example, a bucket, grapple, or hammer) selectably attachable to the machine. The hydraulic systems controlling the tools typically include multiple hydraulic actuators (e.g., piston-cylinder arrangements and/or hydraulic motors) that work in conjunction with a linkage system to affect movement and operation of the tool. Movement of the hydraulic actuators is controlled by various operator input devices, such as one or more control levers, foot pedals, switches, or joysticks.

In addition to selectably attaching tools, a linkage system may also be replaced. The types of tools and linkage system attachable to the machine, as well as the couplers that attach the tools to the machine, often have different shapes, sizes, weights and/or other properties. As such, different combinations of tools and linkage systems (i.e., different implement configurations) may affect the motion control of the machine and react to operator inputs differently. For example, a relatively heavier tool and/or a relatively longer linkage system may establish a relatively greater force moment, caused by the implement configuration, about the machine with respect to a relatively lighter tool and/or shorter linkage system.

One method of improving the motion control of tools is described in U.S. Pat. No. 5,784,945 (the '945 patent) issued to Krone et al. The '945 patent describes an apparatus for determining a valve transform curve in a fluid system. The fluid system includes a fluid actuator with a valve arranged to initiate movement of a load. The system of the '945 patent determines a desired velocity of the fluid actuator based on a sensed load or position of the fluid actuator and generates a valve transform curve to achieve the desired velocity.

Although the system of the '945 patent may improve motion control of the fluid actuator for different loads associated with the actuator, the system of the '945 patent may not provide flexibility when controlling different implement configurations via the same machine. For example, one implement configuration may function undesirably under a given input device position/load/command velocity relationship as compared to another implement configuration attachable to the same machine. Additionally, the system of the '945 patent may not allow the velocity relationship of the fluid actuator to be modified or selected based on different tool and linkage configurations.

The disclosed method and apparatus are directed to overcoming one or more of the shortcomings set forth above or other shortcomings in the art.

SUMMARY OF THE INVENTION

In one aspect, the present disclosure is directed to a method of operating a hydraulic system. The method includes holding an implement configuration in an orientation. The method also includes sensing a pressure within a chamber of a hydraulic actuator associated with the implement configuration when the implement configuration is in the orientation and comparing a first signal indicative of the first sensed pressure with a first pressure value. The method further includes selecting a first functional relationship from among a plurality of stored functional relationships if the first signal is greater than the first pressure value and selecting a second functional relationship from among the plurality of stored functional relationships if the first signal is less than the first pressure value. The method includes controlling the hydraulic actuator based on the selected functional relationship.

In another aspect, the present disclosure is directed to a method of operating a hydraulic system. The method includes moving an implement configuration through a motion. The method also includes sensing a pressure within a chamber of a hydraulic actuator associated with the implement configuration when the implement configuration is moved through the motion and comparing a first signal indicative of the first sensed pressure with a first pressure value. The method further includes selecting a first functional relationship from among a plurality of stored functional relationships if the first signal is greater than the first pressure value and selecting a second functional relationship from among the plurality of stored functional relationships if the first signal is less than the first pressure value. The method includes controlling the hydraulic actuator based on the selected functional relationship.

In yet another aspect, the present disclosure is directed to a machine having a hydraulic system including an implement configuration having a tool and linkage system. The hydraulic system also includes a hydraulic actuator that affects movement of a component of an implement configuration. The hydraulic actuator includes a first chamber and a second chamber. The hydraulic system also includes a sensor that senses pressure within the first or second chambers while the implement configuration is controlled in a first manner. The controller compares a first signal indicative of the sensed pressure with a first pressure value. The controller also selects a first functional relationship from among a plurality of stored functional relationships if the first signal is greater than the first pressure value and selects a second functional relationship from among a plurality of stored functional relationships if the first signal is less than the first pressure value. The controller controls the hydraulic actuator in a second manner based upon the selected functional relationship.

DETAILED DESCRIPTION

Figure 1:
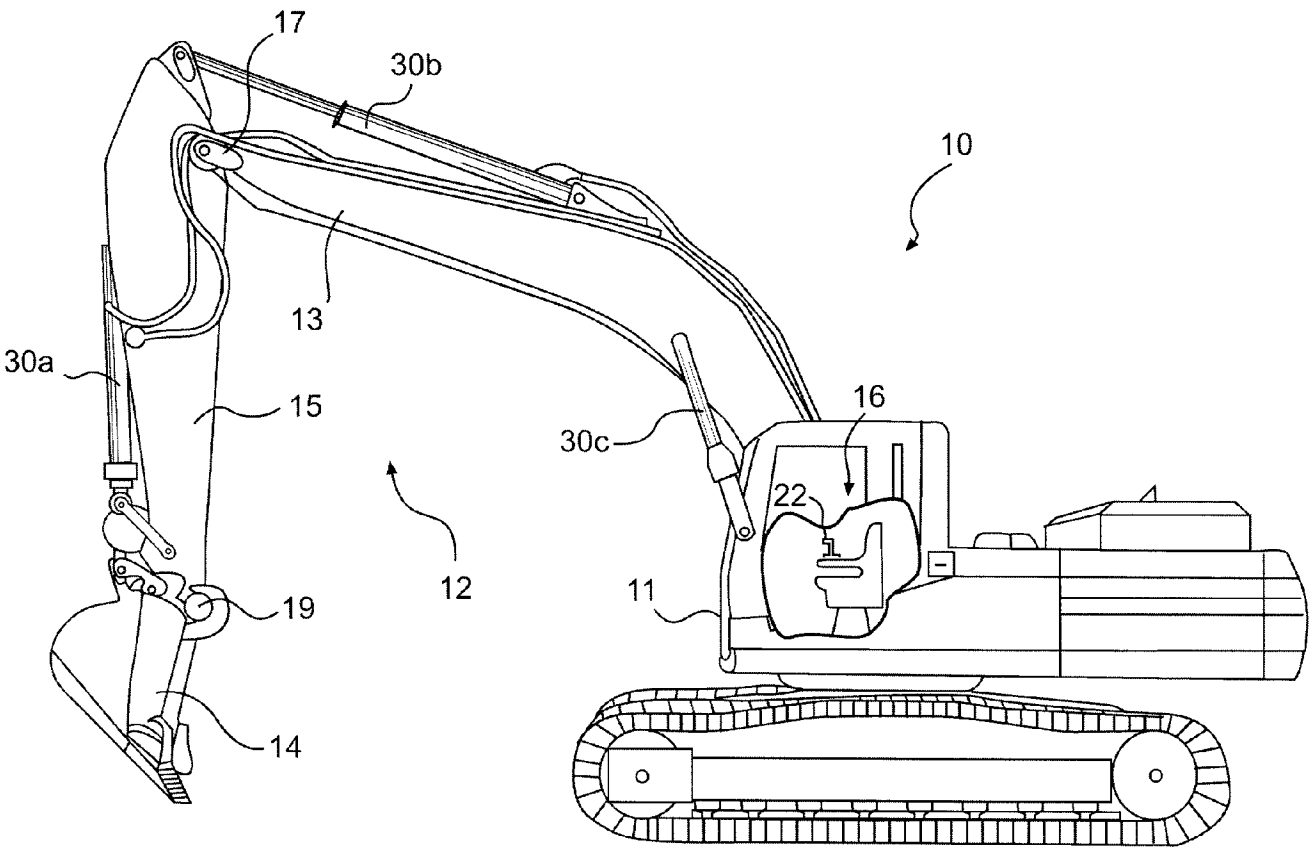
FIG. 1 is a diagrammatic illustration of an exemplary disclosed machine.

FIG. 1 illustrates an exemplary machine 10. Machine 10 may be a fixed or mobile machine that performs some type of operation associated with an industry such as mining, construction, farming, transportation, or any other industry known in the art. For example, machine 10 may be an earth moving machine such as an excavator, a dozer, a loader, or any other known machine. Machine 10 may include a linkage system 12, a tool 14 attachable to linkage system 12 by a coupler (not shown), one or more hydraulic actuators 30*a-c* interconnecting linkage system 12, and an operator interface 16.

Linkage system 12 may include any structural unit that supports movement of machine 10 and/or tool 14. Linkage system 12 may include, for example, a frame 11, a boom 13, and a stick 15. Boom 13 may be pivotally connected to frame 11 and stick 15 may be pivotally connected to boom 13 at a joint 17. Tool 14 may be pivotally connected to stick 15 at a joint 19. It is contemplated that linkage system 12 may alternatively include a different configuration and/or number of linkage members than that depicted in FIG. 1.

Tool 14 may be attachable to stick 15 via a coupler (not shown) and controllable via operator interface 16. Tool 14 may include any device used to perform a particular task such as, for example, a bucket, a grapple, a fork arrangement, or any other task-performing device known in the art. Tool 14 may be configured to pivot, rotate, slide, swing, lift, or move relative to machine 10 in any manner known in the art. It is contemplated that numerous different types of tools may be attachable to stick 15. The combination of linkage system 12 and tool 14 may embody an implement configuration. It is contemplated that various implement configurations may be generally categorized, e.g., light, medium, heavy, or the components of the implement configurations may be generally categorized, e.g., light/medium/heavy tool, light/medium/heavy stick, light/medium/heavy boom.

Operator interface 16 may be configured to receive input from an operator indicative of a desired tool movement. Specifically, operator interface 16 may include an operator interface device 22 such as, for example, a multi-axis joystick located to one side of an operator station. Operator interface device 22 may be a proportional-type controller configured to produce an interface device position signal indicative of a desired movement of tool 14.

Hydraulic actuators 30*a-c* may be connected to frame 11, boom 13, stick 15, and/or tool 14. For example, as shown in FIG. 1, hydraulic actuator 30*a* may be connected to tool 14 and stick 15, hydraulic actuator 30*b* may be connected to stick 15 and boom 13, and hydraulic actuator 30*c* may be connected to frame 11 and boom 13. Hydraulic actuators 30*a-c* may be extended and retracted to cause movement of the components of machine 10 to which they are connected. It is contemplated that hydraulic actuators 30*a-c* may be connected in different arrangements and that machine 10 may include any number of hydraulic actuators.

Figure 2:
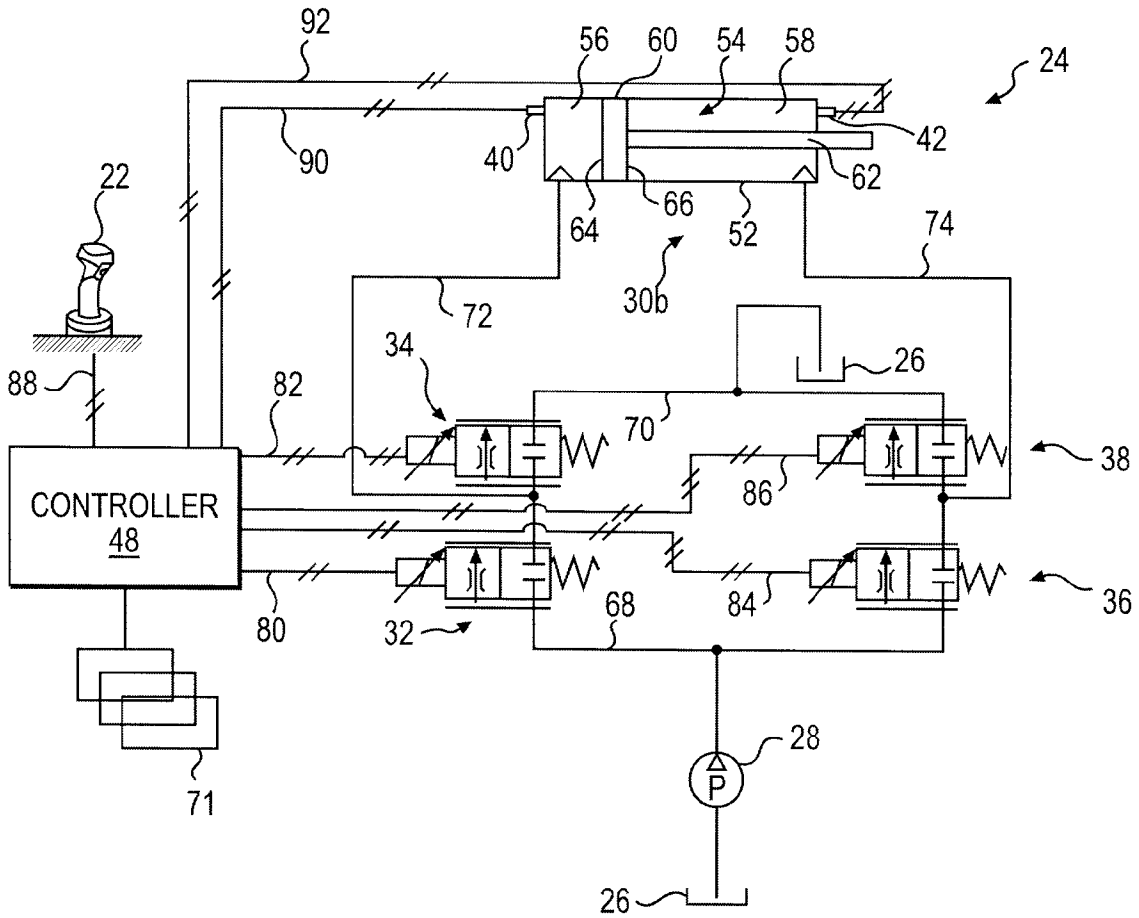
FIG. 2 is a schematic illustration of an exemplary disclosed hydraulic system for the machine of FIG. 1.

As illustrated in FIG. 2, machine 10 may include a hydraulic system 24 having a plurality of components that cooperate to move linkage system 12 and tool 14. Specifically, hydraulic system 24 may include a tank 26 holding a supply of fluid and a pump 28 directing the pressurized fluid to hydraulic actuator 30*b*. While FIG. 1 depicts three actuators, identified as 30*a*, 30*b*, and 30*c*, for the purposes of simplicity, the hydraulic schematic of FIG. 2 depicts only hydraulic actuator 30*b*. The description of hydraulic system 24 and, in particular, hydraulic actuator 30*b*, is equally applicable to hydraulic actuators 30*a*, 30*b*. It is contemplated that hydraulic actuators 30*a* and 30*c* may be included in hydraulic system 24 or hydraulic systems similar to hydraulic system 24.

Hydraulic actuator 30*b* may include a tube 52 and a piston assembly 54 disposed within tube 52. One of tube 52 and piston assembly 54 may be pivotally connected between boom 13 and stick 15. Hydraulic actuator 30*b* may include a first chamber 56 and a second chamber 58 separated by a piston 60 having a piston rod 62. First and second chambers 56, 58 may be selectively supplied with pressurized fluid from pump 28 and selectively drained of the fluid to cause piston assembly 54 to displace within tube 52, thereby changing the effective length of hydraulic actuator 30*b*. The expansion and retraction of hydraulic actuator 30*b* may function to assist in moving boom 13, stick 15, and tool 14. Hydraulic system 24 may include head-end and rod-end pressure sensors 40, 42, which may be in fluid communication with first and second chambers 56, 58, respectively and configured to generate a signal indicative of the pressure of the fluid within first and second chambers 56, 58. Head-end and rod-end pressure sensors 40, 42 may include any type of pressure sensor known in the art. It is contemplated that hydraulic actuators other than fluid cylinders may alternatively be implemented within hydraulic system 24 such as, for example, hydraulic motors and/or any other type of hydraulic actuator known in the art.

Hydraulic system 24 may include a valve arrangement having one or move valves, including a head-end supply valve 32, a head-end drain valve 34, a rod-end supply valve 36, and a rod-end drain valve 38. Head-end supply valve 32 may be disposed between pump 28 and first chamber 56 and rod-end supply valve 36 may be disposed between pump 28 and second chamber 58. Head-end drain valve 34 may be disposed between first chamber 56 and tank 26 and rod-end drain valve 38 may be disposed between second chamber 58 and tank 26. Head-end and rod-end supply valves 32, 36 may be connected in parallel to a common supply passageway 68 extending from pump 28. Head-end and rod-end drain valves 34, 38 may be connected in parallel to a common drain passageway 70 leading to tank 26. Head-end and rod-end supply and drain valves 32, 34, 36 and 38 may be configured to regulate a flow of fluid to and from first and second chambers 56 and 58 in response to the command velocity from controller 48. Head-end and rod-end supply and drain valves 32, 36, 34 and 38 may be movable to any position between fully open and closed positions to vary the rate of flow to and/or from first and second chambers 56 and 58, thereby affecting movement of hydraulic actuator 30*b* and, thus, boom 13, stick 15, and/or tool 14. It is contemplated that hydraulic system 24 may include any arrangement and/or number of valves to affect movement of hydraulic actuator 30*b*. It is further contemplated that hydraulic system 24 may additionally include any arrangement and/or number of valves to affect movement of hydraulic actuators 30*a* and 30*c* if hydraulic actuators 30*a* and 30*b* are included within hydraulic system 24.

Hydraulic system 24 may include a controller 48 in communication with the fluid components of hydraulic system 24 and operator interface device 22. Controller 48 may embody a single microprocessor or multiple microprocessors that control hydraulic system 24. Controller 48 may be in communication with head-end and rod-end supply and drain valves 32, 34, 36, 38 via communication lines 80, 82, 84, 86 respectively, with operator interface device 22 via a communication line 88, and with head and rod-end pressure sensors 40, 42 via communication lines 90 and 92, respectively. Controller 48 may be readily embodied in a general machine microprocessor capable of controlling numerous machine functions. Controller 48 may include a memory, a secondary storage device, a processor, and any other components configured to perform an application. Various other circuits may be associated with controller 48 such as power supply circuitry, signal conditioning circuitry, solenoid driver circuitry, and other types of circuitry.

One or more functional relationships 71 may be stored in the memory of controller 48. Functional relationships 71 may functionally relate operator input and operational parameters corresponding to the first and/or second chambers of hydraulic actuator 30*b*, as well as hydraulic actuators 30*a* and 30*c*, that are appropriate for a category of implement configuration. Functional relationships 71 may be in the form of a map, table, graph, equation, and/or any other functional relationship known in the art. As discussed in detail below, the pressure within the first and/or second chamber of hydraulic actuators 30*a-c* may indicate which category of implement configuration is attached to machine 10. Alternatively, the pressure within the first and/or second chamber of one of hydraulic actuators 30*a-c* may indicate which category of individual component of an implement configuration is attached to machine 10.

Functional relationships 71 may provide data indicative of different operational parameters of machine 10. In particular, functional relationships 71 may provide operational parameters for the general category of implement configuration attached to machine 10 or for categories of individual components of an implement configuration attached to machine 10. The operational parameters provided by functional relationships 71 may be valve position settings that establish one or more of the following with respect to hydraulic actuators 30*a-c*: pressure settings for the first and/or second chambers (e.g., back pressure settings), ranges of motion (e.g., actuation limits), regeneration commands, a force rate limit, a force modulation curve, a velocity modulation curve, and/or maximum velocity settings (e.g., fast, normal, slow). For example, parameters for a relatively heavier implement configuration may include a velocity modulation curve with a reduced maximum velocity to improve controllability of a relatively heavier tool. Additionally, a relatively heavier implement configuration may operate more predictably within a certain range of motion of tool 14 and/or below a maximum velocity of tool 14. Furthermore, a relatively heavier implement configuration may include a valve position setting to achieve increased back pressure which may reduce overrunning load conditions caused by the heavy implement.

It is contemplated that operational parameters may be determined during lab and/or field testing of machine 10 and/or mathematical modeling, and may be periodically recalibrated and updated. It is also contemplated that an operator may experiment with different operational parameters and categories of implement configurations to determine which operational parameters are appropriate for categories of implement configurations.

Figure 3:
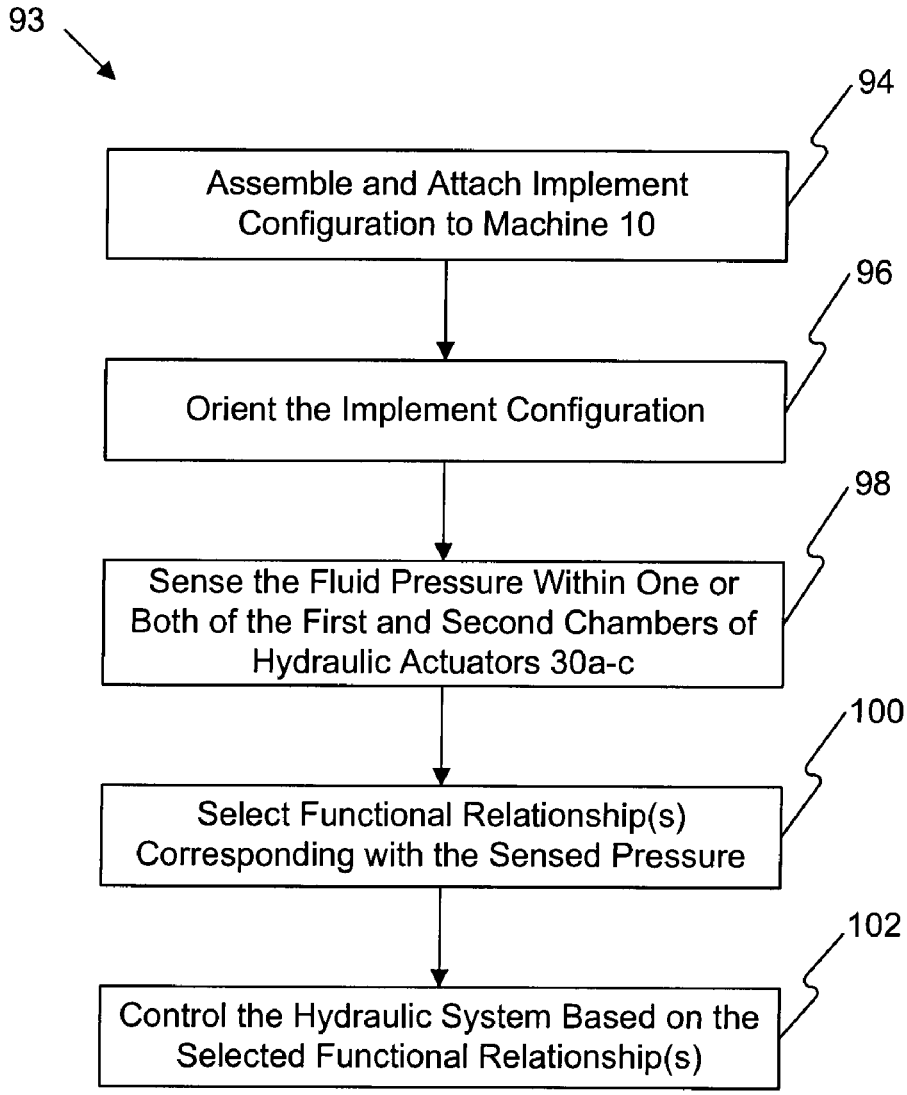
FIG. 3 is a flow chart of an exemplary method of operating the hydraulic system of FIG. 2.

During operation, hydraulic actuators 30*a-c* (FIG. 1) may be movable by fluid pressure in response to an operator input. FIG. 3 illustrates a flow chart depicting an exemplary method 93 of calibrating a hydraulic system e.g., hydraulic system 24, configured to affect movement of one or more hydraulic actuators, e.g., hydraulic actuators 30*a-c*. In step 94, the components of the implement configuration may be assembled and attached to machine 10. In step 96, the implement configuration may be oriented. In step 98, the fluid pressure within one or both of the respective chambers of hydraulic actuators 30*a-c* may be sensed. In step 100, controller 48 may select a functional relationship corresponding to the sensed pressure from functional relationships 71. In step 102, the hydraulic system controlling hydraulic actuators 30*a-c* may be controlled based on the selected functional relationship or relationships. When a new tool and/or linkage system is replaced, steps 94, 96, 98, 100, and 102 may be repeated. Steps 94, 96, 98, 100, and 102 will be discussed in more detail below.

In step 94, the components of the implement configuration may be assembled and attached to machine 10. For example, the components may be configured as shown in FIG. 1, in which the boom 13 is attached to frame 11, stick 15 is attached to boom 13, and tool 14 is attached to stick 15. In step 96, the implement configuration may be placed in an orientation, e.g., an orientation used in calibrating the control system for different implement configurations. Examples of orientations include extending linkage system 12 and tool 14 vertically or horizontally. An operator may use operator interface 16 to move linkage system 12 and tool 14 until the linkage system 12 and tool 14 are vertically or horizontally extended. When different implement configurations are held in the same orientation (e.g., vertically extended), the fluid pressure within the first and second chambers of hydraulic actuators 30*a-c* may vary depending upon the implement configuration attached to machine 10. For example, in comparing two sticks of differing sizes being held in the same orientation, the relatively heavier stick may apply a larger force to hydraulic actuators 30*a-c*. This higher force may correspond to relatively higher fluid pressures within one or both of the respective chambers of hydraulic actuators 30*a-c* to affect movement thereof. Accordingly, the sensed pressure within hydraulic actuators 30*a-c* when stick 15 is held in an orientation may be indicative of a type of category of stick 15, e.g., heavy, medium, light, attached to machine 10. It is contemplated that the implement configurations may be generally categorized, e.g. light, medium, heavy, or the components of the implement configurations may be individually categorized, e.g., light, medium, heavy tool; light, medium, heavy stick; light, medium, heavy boom.

Step 96 may additionally or alternatively include moving the implement configuration through a motion at a constant velocity. When different implement configurations are moved through the same motion, the fluid pressure within one or both of the respective chambers of hydraulic actuators 30*a-c* may vary depending upon the implement configuration attached to machine 10. For example, in comparing two sticks of differing sizes being lifted in the same motion, the relatively heavier stick may apply a larger force to hydraulic actuator 30*a-c*. Accordingly, the sensed pressure within the first chamber of hydraulic actuators 30*a-c* when stick 15 is moved through a motion may be indicative of a type of category, e.g., heavy, medium, light, of stick 15 is attached to machine 10.

In step 98, the fluid pressure within one or both of the respective chambers of hydraulic actuators 30*a-c* may be sensed. The fluid pressure may be sensed by one or both of the head-end and rod-end pressure sensors associated with hydraulic actuators 30*a-c*. As discussed above, when the implement configuration is held in an orientation or moved through a motion, the sensed fluid pressure within the first and/or second chambers of hydraulic actuators 30*a-c* may indicate the category of implement configuration attached to machine 10.

In step 100, controller 48 may select a functional relationship from functional relationships 71 stored in the memory of the controller 48 that corresponds to the sensed pressure. Functional relationships 71 may include a plurality of functional relationships, each corresponding to a general category of implement configuration and a particular pressure value or pressure range for that category. Controller 48 may select one or more of functional relationships 71, each selected functional relationship corresponding to a particular category and pressure value or pressure range. Controller 48 may select a functional relationship by comparing a signal indicative of the sensed pressure of the first and/or second chambers of hydraulic actuators 30*a-c* with a pressure value. For example, controller 48 may select a first functional relationship 71 if the signal is greater than the pressure value or controller 48 may select a second functional relationship 71 if the signal is less than the pressure value. In another example, controller 48 may compare a signal indicative of the sensed pressure with a first pressure range associated with a first functional relationship 71 and a second pressure range associated with a second functional relationship 71. Controller 48 may select the first functional relationship if the signal is within the first pressure range and controller 48 may select the second functional relationship if the signal is within the second pressure range. It is contemplated that controller 48 may determine a force associated with hydraulic actuators 30*a-c* based on the sensed pressure by any method known in the art. Step 100 may include selecting a functional relationship 71 corresponding to the determined force by comparing a signal indicative of the calculated force with a force value.

In another embodiment, functional relationships 71 may include a plurality of functional relationships each corresponding to a particular category of components of an implement configuration and a particular pressure value or pressure range for that category of components. Controller 48 may select one or more of functional relationships 71, each selected functional relationship corresponding to a particular category of a component of an implement configuration and a pressure value or pressure range for that category. The functional relationships 71 may be selected in the manner described above with respect to selecting a functional relationship for an implement configuration. As such, step 100 may be configured to select one or more functional relationships that correspond to the particular implement configuration attached to machine 10, e.g., a particular arrangement of a boom, stick, and/or tool. It is contemplated that the selected functional relationship or functional relationships may correspond to the category, e.g., heavy, medium, light, of implement configuration, or category of particular components, attached to machine 10.

It is contemplated that step 100 may include, instead of selecting a functional relationship, modifying a functional relationship to account for the sensed pressure. That is, if the signal indicative of the sensed pressure is greater than or less than a certain value, the operational parameters provided by one or more functional relationships 71 may include a base set of operational parameters that are modified as a function of the signal. For example, the base set of operational parameters may be individually weighted for various categories of implement configurations.

In step 102, the hydraulic system controlling hydraulic actuators 30*a-c* is controlled based on the selected functional relationship or relationships 71. In other words, the operational parameters of the hydraulic system may be adjusted to be consistent with the selected functional relationship 71. Controller 48 may receive input indicative of a desired tool movement from operator interface device 22. Controller 48 may determine via the one or more selected or modified functional relationships 71, one or more valve commands to affect the desired movement of hydraulic actuators 30*a-c*. As a result, movement of hydraulic actuators 30*a-c* may substantially match the operator expected or desired velocity regardless of the type of implement configuration attached to machine 10.

INDUSTRIAL APPLICABILITY

The disclosed hydraulic control system may be applicable to any machine that includes a hydraulic actuator and may provide improved maneuverability under varying implement configurations. The operation of hydraulic system 24 and, in particular, the calibration of machine 10 will be explained below with reference to a particular example. It is noted that the below explanation is for clarification purposes only.

In one example, the implement configuration shown in FIG. 1 may be replaced by a new implement configuration. Boom 13 may be replaced with a relatively longer boom and tool 14, which is shown as a bucket in FIG. 1, may be replaced with a grapple. In the example, boom 13, stick 15, and tool 14 may be removed from machine 10 and the new boom, stick 15, and the grapple may be assembled and attached to machine 10 (step 94). Because machine 10 may have been previously calibrated for operating the implement configuration shown in FIG. 1, machine 10 may not be calibrated for operating the new implement configuration. Accordingly, after the new implement configuration is attached to machine 10, the operator may use operator interface 16 to move the grapple to an orientation in which it is vertically extended, thus, placing the implement configuration in an orientation (step 96). One or both of the head-end and rod-end pressure sensors associated with each hydraulic actuator 30*a-c* may sense the pressure within the chambers of each hydraulic actuator 30*a-c* while the grapple is extended vertically (step 98). Controller 48 may receive a signal indicative of the sensed pressure of the chambers of hydraulic actuators 30*a-c*.

Controller 48 may compare the signal with a pressure value or pressure ranges associated with functional relationships 71 (step 100). Assuming the grapple, stick 15 and new boom establish a medium tool, light stick, heavy boom configuration, controller 48 may select a single functional relationship 71 corresponding to pressure values or pressure ranges associated with a medium tool, light stick, and heavy boom. It is contemplated that controller 48 may alternatively select a plurality of functional relationships 71, each selected functional relationship 71 corresponding to at least one of the pressure values or pressure ranges associated with a medium tool, light stick, and heavy boom.

The selected functional relationship may provide operational parameters, such as maximum velocities, for each component of the implement configuration. Controller 48 may consult the selected functional relationship and adjust the operational parameters related to the grapple, stick 15, and relatively longer boom to be consistent with the selected functional relationship or relationships 71 (step 102). During subsequent operations, the grapple, stick 15, and relatively longer boom may be, for example, prevented from exceeding the maximum velocities associated with each as provided by the selected functional relationship or relationships 71.

By calibrating machine 10 based upon the sensed pressures within the first and second chambers associated with hydraulic actuators 30*a-c*, different categories of implement configurations may be used with a predictable maneuverability. Because the operational parameters can be set for different categories of implement configurations without knowledge of the identity or properties of tool 14 and linkage system 12, different categories of implement configurations, including unidentified tools and linkage systems may be attached to machine 10 and operated with predictable velocity and control.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A method of operating a hydraulic system, comprising:

holding an implement configuration in an orientation;

sensing a first pressure within at least one chamber of at least one hydraulic actuator associated with the implement configuration when the implement configuration is in the orientation;

comparing a first signal indicative of the first sensed pressure with a first pressure value;

selecting a first functional relationship from among a plurality of stored functional relationships if the first signal is greater than the first pressure value;

selecting a second functional relationship from among the plurality of stored functional relationships if the first signal is less than the first pressure value; and controlling the hydraulic actuator based on the selected functional relationship.

2. The method of claim 1, wherein comparing the first signal with a first pressure value includes comparing the first signal with a first range of pressure values associated with the first functional relationship and a second range of pressure values associated with the second functional relationship.

3. The method of claim 2, further including selecting the first functional relationship if the first signal is within the first range of pressure values, and selecting the second functional relationship if the first signal is within the second range of pressure values.

4. The method of claim 1, wherein each of the plurality of stored functional relationships are associated with a different category of implement configurations.

5. The method of claim 1, wherein the implement configuration includes a plurality of components and each of the plurality of stored functional relationships is associated with a different category of components.

6. The method of claim 1, wherein each of the plurality of stored functional relationships functionally relate operator inputs and operational parameters corresponding to the hydraulic actuator.

7. The method of claim 6, wherein the operational parameters establish pressure settings for the chamber of the hydraulic actuator.

8. The method of claim 6, wherein the operational parameters establish a maximum velocity for a component of the implement configuration.

9. The method of claim 1, further including:

sensing a second pressure within at least one chamber of a second hydraulic actuator associated with the implement configuration; and comparing a second signal indicative of the second pressure with a second pressure value.

10. The method of claim 9, wherein comparing the second signal with the second pressure value includes comparing the second signal with a third range of pressure values associated with a third functional relationship and a second range of pressure values associated with a fourth functional relationship.

11. The method of claim 9, further including selecting the third functional relationship if the second signal is within the third range of pressure values, and selecting the fourth functional relationship if the second signal is within the fourth range of pressure values.

12. A method of operating a hydraulic system, comprising:

moving an implement configuration through a motion;

sensing a first pressure within at least one chamber of at least one hydraulic actuator associated with the implement configuration when the implement configuration moved through the motion;

comparing a first signal indicative of the first sensed pressure with a first pressure value;

selecting a first functional relationship from among a plurality of stored functional relationships if the first signal is greater than the first pressure value;

selecting a second functional relationship from among the plurality of stored functional relationships if the first signal is less than the first pressure value; and controlling the hydraulic actuator based on the selected functional relationship.

13. The method of claim 12, wherein comparing the first signal with the first pressure value includes comparing the first signal with a first range of pressure values associated with the first functional relationship and a second range of pressure values associated with the second functional relationship.

14. The method of claim 13, further including selecting the first functional relationship if the first signal is within the first pressure range, and selecting the second functional relationship if the first signal is within the second pressure range.

15. The method of claim 12, wherein each of the plurality of stored functional relationships are associated with a different category of implement configurations.

16. The method of claim 12, wherein the implement configuration includes a plurality of components and each of the plurality of stored functional relationships are associated with a different category of components.

17. The method of claim 12, wherein each of the plurality of stored functional relationships functionally relate pressure values and operational parameters corresponding to the hydraulic actuator.

18. A machine having a hydraulic system, comprising:

an implement configuration including a tool and a linkage system;

a hydraulic actuator that affects movement of a component of the implement configuration, the hydraulic actuator including a first chamber and a second chamber;

a sensor that senses pressure within at least one chamber while the implement configuration is controlled in a first manner; and a controller in communication with the sensor and configured to compare a signal indicative of the sensed pressure with a first pressure value, modify a stored functional relationship as a function of the signal, and control the hydraulic actuator in a second manner based upon the modified functional relationship.

19. The hydraulic system of claim 18, wherein the first manner includes holding the implement configuration in an orientation.

20. The hydraulic system of claim 18, wherein the first manner includes moving the implement configuration through a motion.

* * * * *